US009630153B2

(12) United States Patent
Lincoln

(10) Patent No.: US 9,630,153 B2
(45) Date of Patent: Apr. 25, 2017

(54) WINE AERATING DEVICES

(71) Applicant: Douglas Lincoln, La Habra, CA (US)

(72) Inventor: Douglas Lincoln, La Habra, CA (US)

( * ) Notice: Subject to any disclaimer, the term of this patent is extended or adjusted under 35 U.S.C. 154(b) by 131 days.

(21) Appl. No.: 14/447,040

(22) Filed: Jul. 30, 2014

(65) Prior Publication Data

US 2015/0037479 A1 Feb. 5, 2015

Related U.S. Application Data

(60) Provisional application No. 61/860,171, filed on Jul. 30, 2013.

(51) Int. Cl.

| | |
|---|---|
| ***B01F 3/04*** | (2006.01) |
| ***B01F 13/00*** | (2006.01) |
| ***B01F 15/00*** | (2006.01) |
| ***B01F 15/02*** | (2006.01) |

(52) U.S. Cl.

CPC ..... *B01F 3/04787* (2013.01); *B01F 3/04262* (2013.01); *B01F 3/04439* (2013.01); *B01F 13/002* (2013.01); *B01F 15/00506* (2013.01); *B01F 15/0247* (2013.01); *B01F 2215/0072* (2013.01)

(58) Field of Classification Search

CPC ..... B01F 3/04787; B01F 3/04439; B01F 3/04262; B01F 13/002; B01F 15/00506; B01F 15/0247; B01F 2215/0072

See application file for complete search history.

(56) References Cited

U.S. PATENT DOCUMENTS

| | | | |
|---|---|---|---|
| 1,597,742 | A | 8/1926 | Turner |
| D96,269 | S | 7/1935 | Milbach |
| D123,419 | S | 11/1940 | Rigby |
| D168,165 | S | 11/1952 | Lutz |
| D176,986 | S | 2/1958 | McPhee |
| D189,374 | S | 11/1960 | Harris |
| D192,909 | S | 5/1962 | Morris |
| D197,983 | S | 4/1964 | Mourreau |
| D213,164 | S | 1/1969 | Reichow |

(Continued)

FOREIGN PATENT DOCUMENTS

| | | | |
|---|---|---|---|
| ES | 2053400 | * | 7/1994 |
| GB | 3679 | * | 0/1913 |

(Continued)

OTHER PUBLICATIONS

"AeraWine Infusion Spirit and Wine Aerator," http://www.aerawine.com; retrieved on Nov. 19, 2013 in 2 pages.

(Continued)

*Primary Examiner* — Anthony Weier

(74) *Attorney, Agent, or Firm* — Knobbe, Martens, Olson & Bear LLP

(57) ABSTRACT

Wine aerating devices and methods of aerating wine are shown. A wine aerating device can include an actuator, a piston movable between first and second positions, a pumping chamber coupled to the piston, and a bubble generating material coupled to the pumping chamber. Upon application and release of a force on the actuator, the piston can move between the first and second positions to inject a metered amount of air from the pumping chamber out through the bubble generating material to generate air bubbles into a container of wine.

22 Claims, 4 Drawing Sheets

(56) References Cited

U.S. PATENT DOCUMENTS

| | | | | |
|---|---|---|---|---|
| D223,693 | S | 5/1972 | Chi | |
| D242,227 | S | 11/1976 | Donoghue | |
| 4,119,244 | A | 10/1978 | Funke | |
| D256,945 | S | 9/1980 | Willis | |
| 4,494,452 | A | 1/1985 | Barzso | |
| 4,723,670 | A | 2/1988 | Robinson et al. | |
| 4,785,724 | A | 11/1988 | Vassallo | |
| 4,889,250 | A | 12/1989 | Beyer | |
| 5,154,112 | A | 10/1992 | Wettern | |
| D344,450 | S | 2/1994 | Zugel | |
| 5,595,104 | A | 1/1997 | Delaplaine | |
| D379,402 | S | 5/1997 | Paul | |
| D386,854 | S | 11/1997 | Koptis | |
| 5,758,700 | A * | 6/1998 | Vanderploeg | B67D 1/008 141/113 |
| 5,823,372 | A | 10/1998 | Levine | |
| 5,851,443 | A | 12/1998 | Rajendren | |
| D407,017 | S | 3/1999 | Lau | |
| D441,253 | S | 5/2001 | Chen | |
| D445,335 | S | 7/2001 | Hou | |
| 6,508,163 | B1 | 1/2003 | Weatherill | |
| D520,359 | S | 5/2006 | Sach | |
| D640,091 | S | 6/2011 | Sheppard et al. | |
| D682,691 | S | 5/2013 | Hewitt et al. | |
| 8,561,970 | B1 | 10/2013 | Mills et al. | |
| D701,080 | S | 3/2014 | Mills et al. | |
| D705,004 | S | 5/2014 | Mills et al. | |
| D712,199 | S | 9/2014 | Borden et al. | |
| D716,612 | S | 11/2014 | Mills et al. | |
| D719,402 | S | 12/2014 | Khan | |
| D720,959 | S | 1/2015 | Mok | |
| D722,872 | S | 2/2015 | Bowman et al. | |
| D725,230 | S | 3/2015 | Chen | |
| 2008/0107785 | A1 | 5/2008 | Roodman et al. | |
| 2010/0006603 | A1 | 1/2010 | Weinberg et al. | |
| 2010/0012612 | A1* | 1/2010 | Miyanaga | C12G 1/06 215/228 |
| 2010/0058933 | A1 | 3/2010 | Cheng | |
| 2010/0090355 | A1 | 4/2010 | Weatherill | |
| 2010/0278980 | A1* | 11/2010 | Tomasello | B01F 3/04262 426/231 |
| 2011/0151085 | A1* | 6/2011 | Wallace | B01F 3/04794 426/477 |
| 2011/0177219 | A1 | 7/2011 | Roodman et al. | |
| 2011/0297006 | A1 | 12/2011 | Belcher | |
| 2013/0153685 | A1* | 6/2013 | Drobot | B01F 5/0428 239/428.5 |
| 2014/0103549 | A1* | 4/2014 | Staneland | B67D 3/0035 261/62 |

FOREIGN PATENT DOCUMENTS

| | | | |
|---|---|---|---|
| GB | 18435 | * | 0/1904 |
| GB | 11708 | * | 5/1908 |
| WO | WO 96/12644 | * | 5/1996 |

OTHER PUBLICATIONS

"EverythingbutWine," http://www.everythingbutwine.com/Wine-Breather-Air-Infusion-Pump; retrieved on Nov. 19, 2013 in 2 pages.

"Aermate Wine and Spirits Aerator: How It Works," http://aermate.com/how-it-aerates-wine-spirits; retrieved on Nov. 19, 2013 in 3 pages.

"soiree aerator," http://soireehome.com/products/soiree; retrieved on Nov. 21, 2013 in 2 pages.

"The Sharper Image® Flavor Enhancing Wine Aerator," http://www.bedbathandbeyond.com/store/product/the-sharper-image-reg-flavor-enhancing-wine-aerator/1016827959; retrieved on Nov. 21, 2013 in 2 pages.

"Definition of infuse," http://education.yahoo.com/reference/dictionary/entry/infuse; retrieved on Nov. 21, 2013 in 2 pages.

"Definition of air," http://education.yahoo.com/reference/dictionary/entry/air; retrieved on Nov. 21, 2013 in 2 pages.

"SAVE Aero™ Wine Aerator by Brookstone," http://www.brookstone.com/aero-full-bottle-wine-aerator; retrieved on Nov. 21, 2013 in 2 pages.

"The Aermate Wine and Spirits Aerator review," http://the-gadgeteer.com/2014/01/14/the-aermate-wine-and-spirits-aerator-review; retrieved on Jul. 17, 2014 in 8 pages.

* cited by examiner

WINE AERATING DEVICES

CROSS-REFERENCE TO RELATED APPLICATIONS

This application claims the benefit of U.S. Provisional Patent Application No. 61/860,171, filed Jul. 30, 2013, which is incorporated in its entirety by reference herein.

BACKGROUND

Field of the Invention

This disclosure relates to devices and methods for aerating liquids, in particular to wine aerating devices and methods for aerating wine.

Description of the Related Art

It may be desired to add air into certain liquids. For example, wine is often aerated to improve its taste. After a bottle of wine is opened, the wine is often exposed to air for a length of time prior to consumption. Wine aerating devices, e.g., aerators, can be used to help reduce the "breathing" time. However, current wine aerators are subject to many disadvantages such as clogging, inability to control the amount of air delivered, use of materials that contact the wine that are not approved by the U.S. Food and Drug Administration (FDA), difficulty of operation, difficulty in cleaning, and bottle overflow.

Certain embodiments of wine aerating devices as described herein have chemical, physical, and mechanical properties that enable the devices to accomplish the goal of aeration of a full bottle of wine without incurring the problems listed above. In addition, certain embodiments of wine aerating devices and methods to aerate wine as described herein are able to reduce the breathing time and improve the wine's taste by infusing an optimized amount of air and/or bubble size into the wine. Although various embodiments are described with respect to aerating wine, aeration of other liquids is also contemplated.

SUMMARY

Certain embodiments described herein include a wine aerating device. The wine aerating device can include an actuator, a piston movable between first and second positions, a pumping chamber coupled to the piston, and a bubble generating material coupled to the pumping chamber. Upon application and release of a force on the actuator, the piston can move between the first and second positions to inject a metered amount of air from the pumping chamber out through the bubble generating material to generate air bubbles into a container of wine.

In some embodiments, movement of the piston from the first position to the second position injects the metered amount of air towards the bubble generating material and further movement of the piston from the second position back to the first position allows air into the pumping chamber. In some other embodiments, movement of the piston from the first position to the second position allows air into the pumping chamber, and further movement of the piston from the second position back to the first position injects the metered amount of air towards the bubble generating material. In various embodiments, the metered amount of air can be between about 1 cubic inch to about 1.4 cubic inches.

The wine aerating device as described herein can further include a spring coupled to the piston that moves the piston from the second position back to the first position. The wine aerating device can also further include a transfer tube between the pumping chamber and the bubble generating material. In certain embodiments, the bubble generating material can be substantially wine-phobic and can allow substantially no wine into the device. The bubble generating material can be substantially non-wicking. For example, in various embodiments, the bubble generating material can have a surface energy that is between about 10 dynes/cm to about 45 dynes/cm. In certain embodiments, the bubble generating material can have a surface energy that is less than the surface energy of wine by about 10 dynes/cm to about 45 dynes/cm. One example bubble generating material is fluoropolymer. The bubble generating material can have an average pore diameter that is between about 0.4 micron to about 0.7 micron, and the generated air bubbles can have an average bubble diameter that is between about 0.03 inches to about 0.07 inches.

Certain embodiments described herein can include a method of aerating a container of wine. The method can include providing a bubble generating material in the container of wine. The bubble generating material can be coupled to a pumping chamber; and the pumping chamber can be coupled to a piston. The piston can be movable between first and second positions and coupled to an actuator. The method can also include applying and releasing a force on the actuator such that the piston moves between the first and second positions. Furthermore, the method can include injecting a metered amount of air from the pumping chamber out through the bubble generating material to generate air bubbles into the container of wine.

In some embodiments, injecting the metered amount of air occurs simultaneously with applying the force on the actuator. In some other embodiments, injecting the metered amount of air occurs simultaneously with releasing the force on the actuator. Injecting the metered amount of air can include injecting between about 1 cubic inch to about 1.4 cubic inches of air. Injecting the metered amount of air can include generating air bubbles having an average bubble diameter that is between about 0.03 inches to about 0.07 inches into the container of wine.

In various embodiments of the method, providing a bubble generating material can include providing a bubble generating material having an average pore diameter that is between about 0.4 micron to about 0.7 micron. Providing a bubble generating material can also include providing a bubble generating material that is substantially wine-phobic and allowing substantially no wine into the device. For example, in various embodiments, providing a bubble generating material can include providing a bubble generating material that has a surface energy that is between about 10 dynes/cm to about 45 dynes/cm. In certain embodiments, providing a bubble generating material can include providing a bubble generating material that has a surface energy that is less than the surface energy of wine by about 10 dynes/cm to about 45 dynes/cm. Providing a bubble generating material can include providing a fluoropolymer.

Certain embodiments as described herein can also include a wine aerating device including a housing, a gas chamber within the housing, a controller operatively coupled to the gas chamber, and a bubble generating material comprising a fluoropolymer. The bubble generating material can be coupled to the gas chamber, and actuating the controller can inject a metered amount of gas from the gas chamber out through the bubble generating material to generate bubbles into a container of wine. In some such embodiments, actuating the controller injects the metered amount of gas using an electric motor to drive a pump. In other such embodiments, actuating the controller injects the metered amount of gas using a stored energy pump. Furthermore, in some embodiments, the gas chamber can include a compressed gas canister.

DETAILED DESCRIPTION

Various embodiments can include a device that is a combination of many subsystems and components that dispense fine air bubbles into a glass or a full bottle of wine. The introduction of air into wine has the effect of releasing subtle flavors that are normally hidden or only available after lengthy aeration processing such as decanting. The device can allow the wine drinker to enjoy the full richness of the wine after only a few (e.g., two or three) strokes of an actuator (e.g., a manually operated handle). For example, as will be described herein, the wine aerating device can include an actuator, a piston movable between first and second positions, a pumping chamber coupled to the piston, and a bubble generating material coupled to the pumping chamber. Upon application and release of a force on the actuator, the piston can move between the first and second positions to inject a metered amount of air from the pumping chamber out through the bubble generating material to generate air bubbles into a container of wine. The air bubbles can rise up through the wine to expose a full bottle of wine to the surfaces of the air bubbles. Thus, certain embodiments can provide a metered or a measured amount of air (for example, an optimized amount of air, which can be between about 1 cubic inch to about 1.4 cubic inches) and/or optimized bubble sizes (for example, bubbles having an average diameter less than about 0.07 inches) into the wine to decrease the breathing time and improve the taste of the wine. "Air" as used herein can include the gas that surrounds the earth in total and/or each individual gas that combines to make such gas that surrounds the earth in total.

Figure 1:
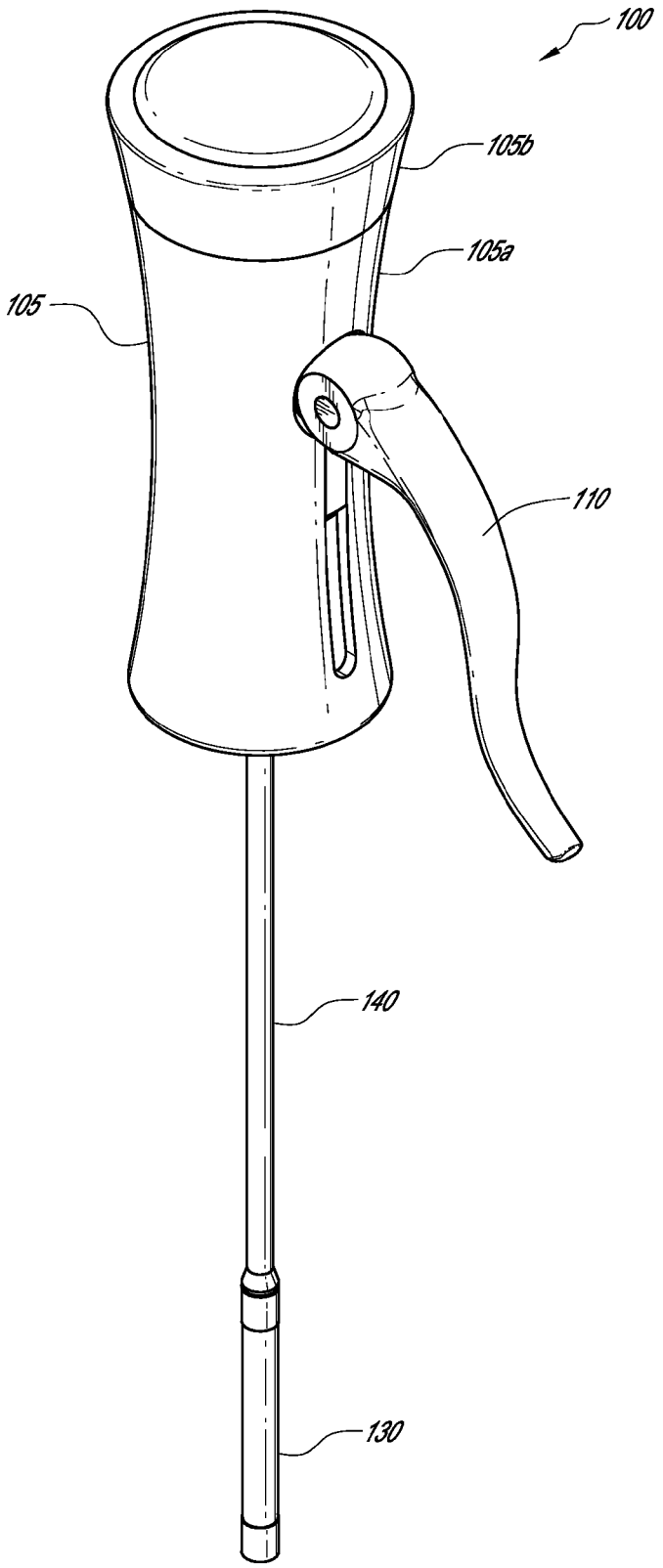
FIG. 1 is a perspective view of an example wine aerating device in accordance with certain embodiments described herein.

The device can include a unique combination of common concepts and highly engineered concepts to accomplish full bottle wine aeration. FIG. 1 is a perspective view of an example wine aerating device in accordance with certain embodiments described herein. As shown in the example wine aerating device 100, from an exterior view, the device 100 can include a housing 105, an actuator 110, a bubble generating material 130, and a transfer tube 140. In certain embodiments, the metered amount of air can be measured within the housing 105 and injected into the transfer tube 140 and out through the bubble generating material 130 creating the optimized bubble sizes.

In some embodiments, the housing 105 can comprise a unitary piece of material or can comprise multiple components. For example, as shown in FIG. 1, the housing 105 can include a housing body 105*a* and a cap 105*b* above the housing body 105*a*. In some embodiments, air can enter into the housing 105 through the space between the housing body 105*a* and the cap 105*b*.

Figure 2B:
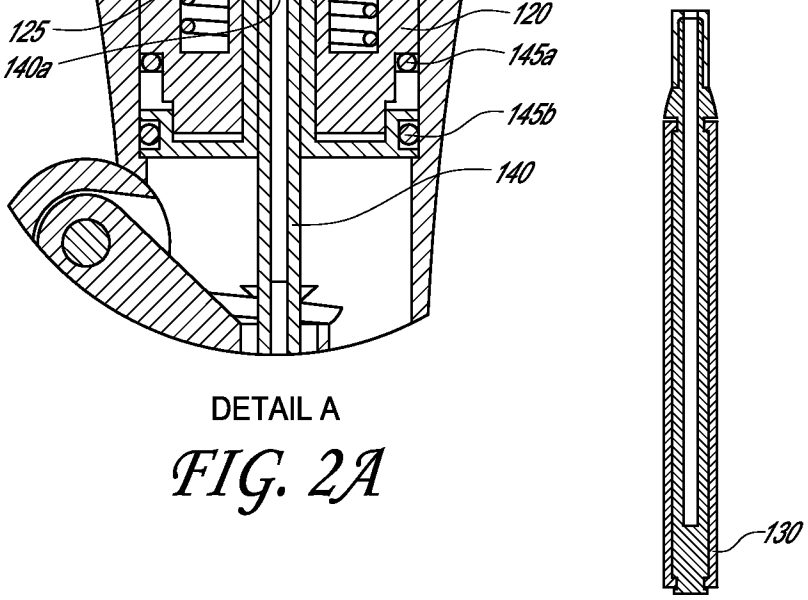
FIGS. 2A and 2B are enlarged views of the portions labeled as A and B of the device shown in FIG. 2.
Figure 2A:
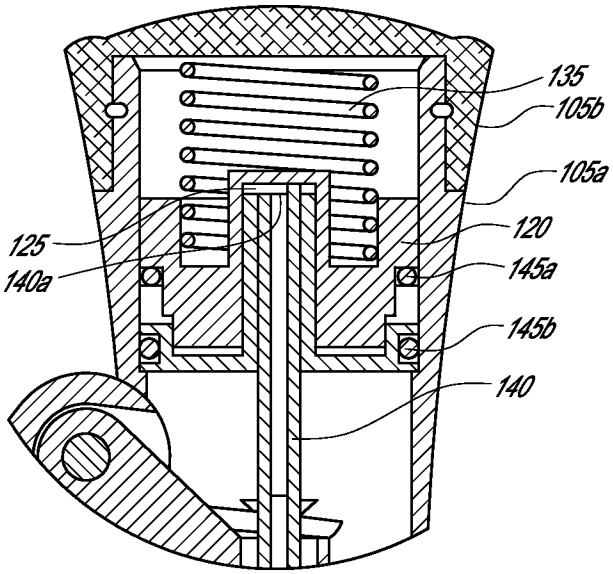
Figure 2:
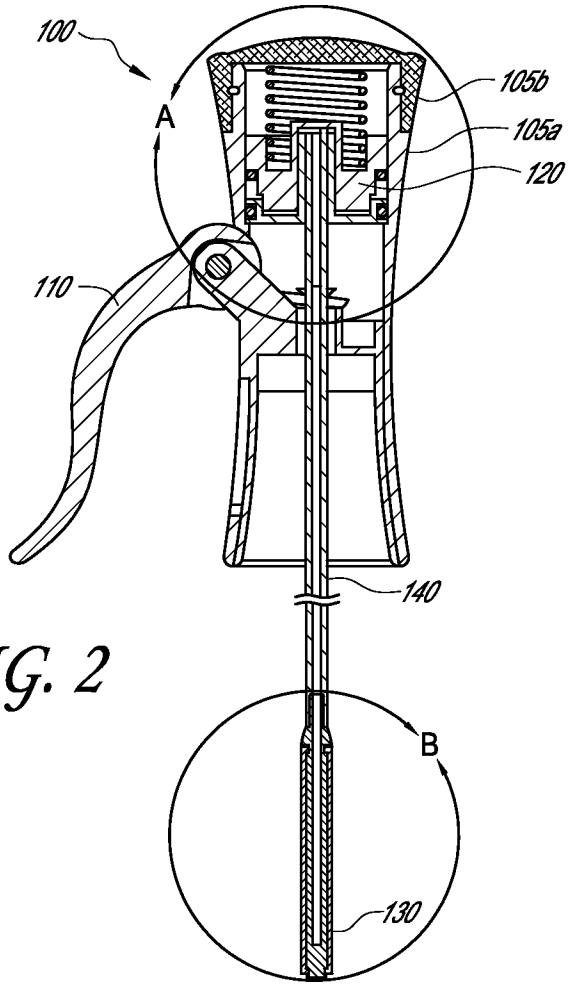
FIG. 2 schematically illustrates a cross-sectional view of the example device shown in FIG. 1.

FIG. 2 schematically illustrates a cross-sectional view of the example device 100 shown in FIG. 1. FIGS. 2A and 2B are enlarged views of the portions labeled respectively as A and B of the device 100 shown in FIG. 2. As shown in FIGS. 2 and 2A, within the housing 105, certain embodiments include a piston 120 that can be movable between first and second positions. The device 100 also can include a pumping chamber 125 coupled to the piston 120. The device 100 can further include a spring (e.g., a compression spring or other resilient member) 135 coupled to the piston 120 that moves the piston 120 from the second position back to the first position. In certain embodiments, the pumping chamber 125 is coupled to the bubble generating material 130 by the transfer tube 140.

In the example embodiment, the action of putting (e.g., pumping) air into a bottle of wine can be accomplished by the actuator 110 that actuates the piston 120. For example, upon application and release of a force on the actuator 110, the piston 120 can move between the first and second positions to inject a metered amount of air from the pumping chamber 125 out through the bubble generating material 130 to generate air bubbles into the container of wine. In certain embodiments, the actuator 110 can include a handle that is aesthetically designed to not only enhance the appearance of the device 100, but to provide a comfortable hand position throughout the full range of motions. A handle can also include the features that can move the internal components (e.g., the piston 120 and spring 135), thus accomplishing the intended function of the device 100.

In certain embodiments, the spring 135 returns the piston 120 and actuator 110 to the original starting position after a full or partial actuation of the actuator 110. In some embodiments, the device 100 can be configured such that both a full and a partial actuation of the actuator 110 results in substantially the same amount of air within the pumping chamber 125 which would then enter the transfer tube 140 towards the bubble generating material 130.

For example, with reference to FIGS. 2 and 2A, upon the forward stroke as the actuator 110 is depressed towards the housing 105, the piston 120 and transfer tube 140 move in an upward direction compressing the spring 135. Such movement can enlarge the size (e.g., volume) of the pumping chamber 125 and allow air to enter into the enlarged pumping chamber 125. For example, air can enter into the pumping chamber 125 through the space between the housing body 105*a* and the piston 120. As the actuator 110 is released, the spring 135 moves the piston 120 back in a downward direction. Such movement can decrease the size (e.g., volume) of the pumping chamber 125, compress the air within the pumping chamber 125, and allow the air from the pumping chamber 125 to enter into an opening 140*a* in the transfer tube 140. Thus, in certain embodiments, movement of the piston 120 from the first position to the second position can allow air into the pumping chamber 125, and further movement of the piston 120 from the second position back to the first position can inject the metered amount of air towards the bubble generating material 130.

Figure 3A:
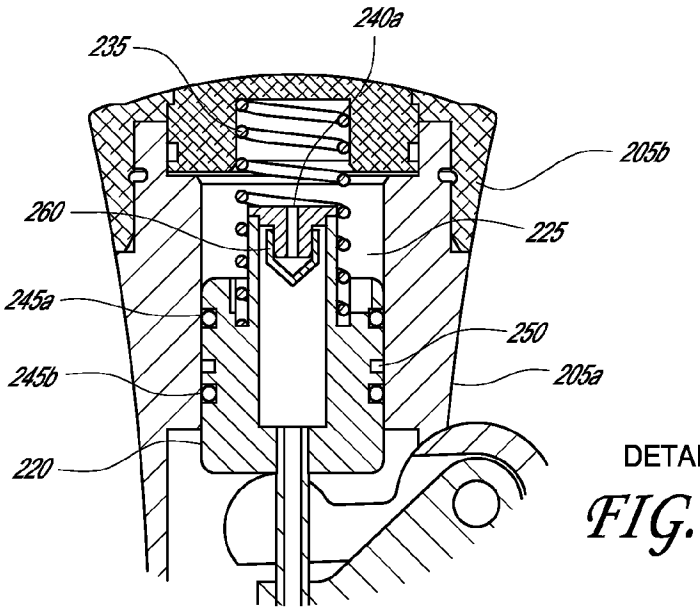
FIGS. 3A and 3B are enlarged views of the portions labeled as A and B of the device shown in FIG. 3.
Figure 3B:
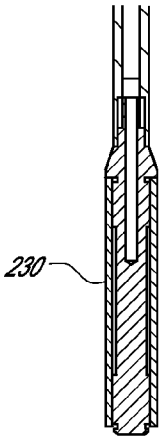
Figure 3:
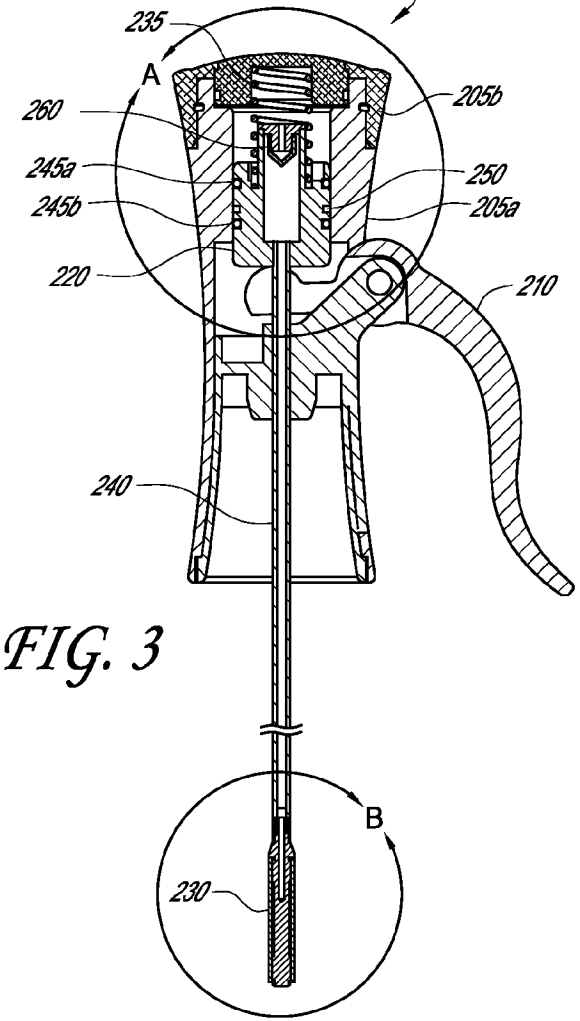
FIG. 3 schematically illustrates a cross-sectional view of another example device in accordance with certain embodiments described herein.

In other embodiments, the direction of the pumping action can be reversed. For example, FIG. 3 shows an example cross-sectional view of such an embodiment. The device 200 shown in FIG. 3 can have similar components as described herein and shown for the device 100 shown in FIGS. 1 and 2. For example, as shown in FIG. 3, the housing 205 can include a housing body 205*a* and a cap 205*b* above the housing body 205*a*. FIGS. 3A and 3B are enlarged views of the portions labeled respectively as A and B in FIG. 3.

In some such embodiments, as shown in FIGS. 3 and 3A, the size (e.g., volume) of the pumping chamber 225 is already enlarged and filled with air. Upon the forward stroke as the actuator 210 is depressed towards the housing 205, the piston 220 and transfer tube 240 move in an upward direction compressing the spring 235. Such movement can decrease the size (e.g., volume) of the pumping chamber 225, compress the air in the pumping chamber 225, and allow the air from the pumping chamber 225 to enter the opening 240*a* in the transfer tube 240. As the actuator 210 is released, the spring 235 moves the piston 220 back in a downward direction. Such movement can enlarge the size (e.g., volume) of the pumping chamber 225 and allow air in the pumping chamber 225. Thus, in certain embodiments, movement of the piston 220 from the first position to the second position can inject the metered amount of air towards the bubble generating material 230 and further movement of the piston 220 from the second position back to the first position can allow air into the pumping chamber 225.

In some embodiments, e.g., as shown in FIG. 3A, the piston 220 can also include a seal (e.g., an o-ring) that helps prevent further air from entering into the opening 240*a* of the transfer tube 240, resulting in the metered or measured amount of air (e.g., a consistently optimized amount of air) infused into the wine upon each stroke and release of the actuator 210.

For example, an upper o-ring 245*a* and a lower o-ring 245*b* can be used in the device 200 shown in FIG. 3A. The upper o-ring 245*a* can act as a check valve to help eliminate the possibility of the user inadvertently blocking the air intake or otherwise fouling the operation of the device 200. In various embodiments, when the actuator 210 is depressed, the upper o-ring 245*a* seals, compressing the air in the pumping chamber 225. When the actuator 210 is released, the upper o-ring 245*a* does not seal, allowing air into the pumping chamber 225.

The lower o-ring 245*b* on the piston 220 can act as a seal when the actuator 210 is depressed and released. The seal can control the path by which the air enters the pumping chamber 225. For example, in some embodiments, upper and lower o-rings 245*a*, 245*b* seal the pathways when the actuator 210 is depressed except for a hole 250 drilled in between the upper and lower o-rings 245*a*, 245*b*. In some embodiments, the hole 250 can be about a 0.01 inch (about 0.02 cm to about 0.03 cm) in size (e.g., in diameter). Blocking the pathways except for the hole 250 helps control the rate at which air enters the pumping chamber 225 and thus helps control the rate at which the actuator 210 returns to its original position. In some embodiments, the actuator 210 return rate can be about 4 seconds, about 5 seconds, or about 6 seconds. This rate can allow the aeration of wine to complete prior to the actuator 210 returning to its original position. One or more o-rings 145*a*, 145*b* can also be used in the device 100 shown in FIGS. 2 and 2A to control air flow in and out of the pumping chamber 125. Accordingly, the seals can help result in the metered amount of air.

In some embodiments, the metered amount of air can be between about 1 cubic inch to about 1.4 cubic inches (between about 16.4 $cm^3$ to about 22.9 $cm^3$) or between about 1.1 cubic inches to about 1.3 cubic inches (between about 18 $cm^3$ to about 21.3 $cm^3$). For example, the metered amount of air can be about 1.15 cubic inches (about 18.8 $cm^3$), about 1.2 cubic inches (about 19.7 $cm^3$), or about 1.25 cubic inches (about 20.5 $cm^3$) of air.

In various embodiments, the piston, for example 220 in FIGS. 3 and 3A, can also house a check valve 260. The check valve 260 can be located in between the pumping chamber 225 and the transfer tube 240. The check valve 260 can allow air to pass from the pumping chamber 225 to the transfer tube 240, but not pass from the transfer tube 240 to the pumping chamber 225. In certain such embodiments, when the actuator 210 is released, the check valve 260 helps prevent air from the transfer tube 210 from being pulled back into the pumping chamber 225 so that the pumping chamber 225 can build sufficient pressure to push the air into the wine. A check valve 260 can also be used in the device 100 shown in FIGS. 2 and 2A.

While the following refers to the reference numerals shown for device 100 in FIGS. 2, 2A, and 2B for simplicity, the following can also describe the device 200 shown in FIGS. 3, 3A, and 3B. In the example embodiment shown in FIGS. 2, 2A, and 2B (or FIGS. 3, 3A, and 3B), the transfer tube 140 (or 240) delivers the air to a bubble generating portion of the device 100 (or 200), labeled as B. The bubbles are generated by passing the pressurized air from the pumping chamber 125 (or 225) through the transfer tube 140 (or 240) and out through the bubble generating material 130 (or 230). In some embodiments, the bubble generating portion of the device 100 (or 200) can be located at the extreme end of the transfer tube 140 (or 240), thus placing a bubble generating material 130 (or 230) or a porous membrane near the bottom of a wine container (e.g., a glass or a standard 750 ml bottle). Placing the bubble generating material 130 (or 230) near the bottom of the wine glass or bottle can help ensure aeration of the entire container.

During normal operation, the bubble generating material 130 (or 230), in these examples, is moved in the vertical direction. This movement can cause the bubbles to break off from the bubble generating material 130 (or 230) sooner than in a static application. This movement is done to help create an optimized bubble size (e.g., bubbles having an average diameter less than about 0.07 inches), thus maximizing surface area exposure of the wine to the bubbles being generated.

The bubble generating material 130 (or 230) can be "wine-phobic" which can generate optimized bubbles by allowing the pressurized air from the pumping chamber 125 (or 225) to pass through holes (e.g., sub-micron sized holes), while helping to eliminate any ingress of wine into the internal passages and chambers of the device 100 (or 200). For example, the bubble generating material 130 (or 230) can allow air out of the device 100 (or 200), yet allow substantially no wine into the device. In some embodiments, the bubble generating material 130 (or 230) can allow less than about 1%, much less than about 1%, less than about 0.05%, less than about 0.03%, less than about 0.02%, less than about 0.01%, or 0% of wine into the device.

In certain embodiments, the pore size of the bubble generating material 130 (or 230) and the surface tension/energy between the bubble generating material 130 (or 230) and wine are optimized such that the bubble generating material 130 (or 230) reduces wicking or is substantially non-wicking. For example, without being bound by theory, in some embodiments, wicking may occur when the surface energy of the solid material is higher than the surface energy of the liquid. Thus, wicking can be reduced in some embodiments when the surface energy of the bubble generating material 130 (or 230) is less than that of the wine. Furthermore, without being bound by theory, the farther apart the surface energies are, the less likely the material will wick. Thus, in some embodiments, the bubble generating material 130 (or 230) can be a fluoropolymer, e.g., a fluoropolymer having a surface energy of about 18-20 dynes/cm (e.g., 19 dynes/cm) when the surface energy of wine can be about 50-60 dynes/cm (e.g., 55 dynes/cm, 56 dynes/cm, or 57 dynes/cm). In some such embodiments, since the surface energy of the example fluoropolymer is much less than the surface energy of the wine (e.g., a difference of greater than about 30 dynes/cm), the bubble generating material 130 (or 230) can be substantially non-wicking.

Accordingly, in various embodiments, the bubble generating material 130 (or 230) can have a surface energy that is less than or equal to about 50 dynes/cm, less than or equal to about 45 dynes/cm, less than or equal to about 40 dynes/cm, less than or equal to about 35 dynes/cm, less than or equal to about 30 dynes/cm, less than or equal to about 25 dynes/cm, less than or equal to about 20 dynes/cm, less than or equal to about 15 dynes/cm, or less than or equal to about 10 dynes/cm. In some embodiments, the surface energy of the bubble generating material 130 (or 230) can be between about 10 dynes/cm to about 45 dynes/cm, between about 10 dynes/cm to about 40 dynes/cm, between about 10 dynes/cm to about 35 dynes/cm, between about 10 dynes/cm to about 30 dynes/cm, or between about 10 dynes/cm to about 25 dynes/cm. For example, the surface energy of the bubble generating material 130 (or 230) can be about 45 dynes/cm, about 40 dynes/cm, about 35 dynes/cm, about 30 dynes/cm, about 25 dynes/cm, about 20 dynes/cm, about 15 dynes/cm, or about 10 dynes/cm.

In addition, in certain embodiments, the surface energy of the bubble generating material 130 (or 230) can be less than the surface energy of wine by at least about 10 dynes/cm, by at least about 15 dynes/cm, by at least about 20 dynes/cm, by at least about 25 dynes/cm, by at least about 30 dynes/cm, by at least about 35 dynes/cm, by at least about 40 dynes/cm, or by at least about 45 dynes/cm. In some embodiments, the surface energy of the bubble generating material 130 (or 230) can be less than the surface energy of wine by about 10 dynes/cm to about 45 dynes/cm, by about 15 dynes/cm to about 45 dynes/cm, by about 20 dynes/cm to about 45 dynes/cm, or by about 25 dynes/cm to about 45 dynes/cm.

In certain embodiments, the average pore size (e.g., diameter) of the bubble generating material 130 (or 230) is less than about 0.7 micron, less than about 0.6 micron, less than about 0.5 micron, or less than about 0.4 micron. In some embodiments, the average pore size (e.g., diameter) can be between about 0.4 micron to about 0.7 micron, or between about 0.4 micron to about 0.6 micron. For example, the average pore size (e.g., diameter) can be about 0.4 micron, about 0.45 micron, about 0.5 micron, about 0.55 micron, or about 0.6 micron.

In some embodiments, the size of the generated bubbles can have an average diameter less than about 0.07 inches (less than about 1.8 mm), less than about 0.06 inches (less than about 1.5 mm), less than about 0.05 inches (less than about 1.3 mm), less than about 0.04 inches (less than about 1 mm), or less than about 0.03 inches (less than about 0.8 mm). In some embodiments, the average bubble diameter is between about 0.03 inches to about 0.07 inches, between about 0.04 inches to about 0.06 inches, or between about 0.03 inches to about 0.06 inches. For example, the average bubble diameter can be about 0.03 inches, about 0.04 inches, about 0.05 inches, or about 0.06 inches. Without being bound by theory, such fine bubble sizes can increase the surface area of wine exposed to air. By increasing the surface area of wine exposed to air, the "breathing time" and taste of wine can be improved.

In various embodiments, the desired bubble size(s) to be generated, the pore size(s) in the bubble generating material 130 (or 230), and/or the metered amount(s) of air to be injected into the wine were determined after considering a variety factors. For example, the generated bubble size can be affected by the viscosity of the wine, the depth of the bubble generating material 130 (or 230) within the wine, the pore size in the bubble generating material 130 (or 230), and static or dynamic application of the item releasing the bubbles. Furthermore, the generated bubble size can be affected by the pressure generated in the pumping chamber 125 (or 225) prior to the injection of the air into the wine. This parameter also can have an impact on the user to comfortably move the actuator 110 (or 210). For example, in general, the higher the pressure, the more difficult it may be to move the actuator 110 (or 210). Accordingly, the values for the bubble size(s) to be generated, the pore size(s) in the bubble generating material 130 (or 230), and/or the metered amount(s) of air to be injected into the wine as described herein were determined after considering the various factors along with the general appearance (e.g., aesthetic appeal) of the bubbles and taste of the wine.

The size, shape, and materials of the different parts of the device 100 (or 200) are not particularly limited. In some embodiments, the housing 105, (or 205) actuator 110 (or 210), and transfer tube 140 (or 240) can be constructed of aerospace grade aluminum alloys (for example, 6061-T6, 7075-T6, or A356-T6). These parts can then undergo surface treatments to preserve their aesthetic luster, and to reduce water spotting. For example, surface treatments can include high luster polishing, anodizing, and/or metal (nickel, copper silver or gold) plating. In addition, the seals utilized in certain embodiments of the device 100 (or 200) can include those that have been approved by the National Aeronautics and Space Administration (NASA) for use in the International Space Station drinking water system. Such seals have an exceptionally low wear rate thus maintaining ultra-high purity, e.g., 99% purity or better, within the device 100 (or 200). For example, certain o-rings have been tested for thirty years of service resulting in more than a million cycles with no significant signs of wear. Showing no signs of wear, the o-rings can prevent substantially no particulate release to enter the system.

The bubble generating material 130 (or 230) and associated assembly adhesives in certain embodiments can be those approved by the U.S. Food and Drug Administration (FDA) and approved in medical devices that contact human blood. Advantages of using these materials in certain embodiments include their ultra-high purity and safety of the user while protecting and enhancing of the wine being aerated. For example, in certain embodiments, the bubble generating material 130 (or 230) can include a fluoropolymer, e.g., an expanded fluoropolymer fiber within the Teflon family. In certain embodiments, various aspects of the fluoropolymer are not particularly limited. For example, the color, shape, pore size, density, and/or flux rate can vary. A molded plastic, such as an acetal resin, e.g., Delrin® by Dupont™, can be used to couple the transfer tube 140 (or 240) to the bubble generating material 130 (or 230).

Figure 4:
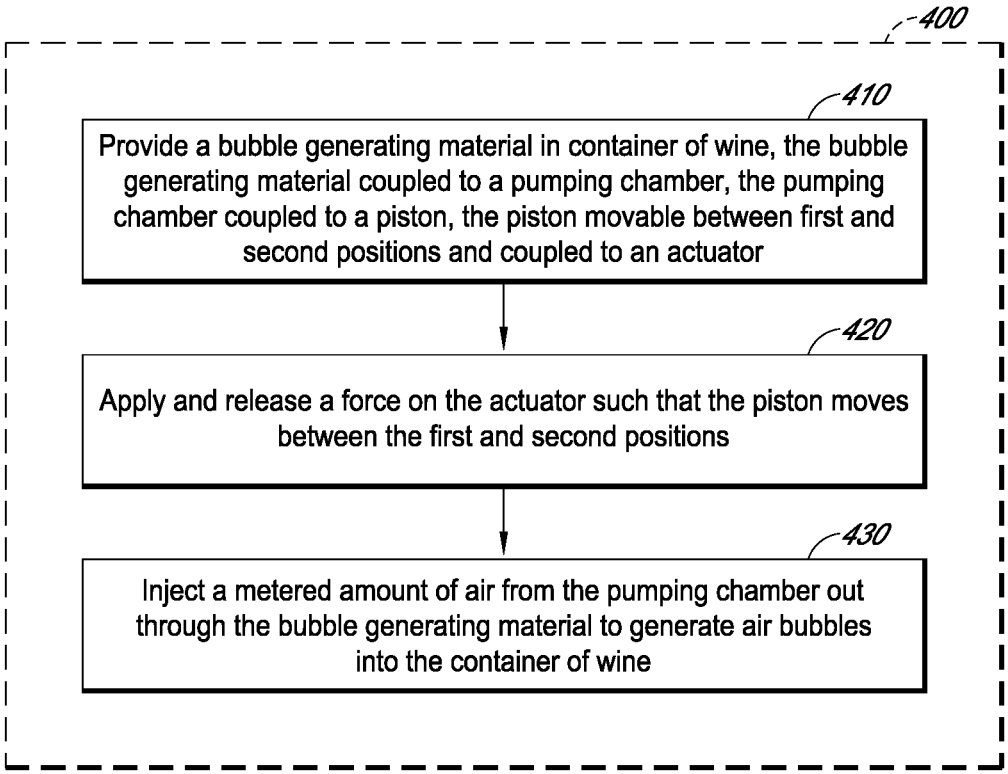
FIG. 4 is a flowchart of an example method of aerating wine in accordance with certain embodiments described herein.

FIG. 4 is a flowchart of an example method of aerating wine in accordance with certain embodiments described herein. As shown in operational block 410, the method 400 can include providing a bubble generating material 130 (or 230) in a container of wine. The bubble generating material 130 (or 230) can be those as described herein in FIGS. 2, 2A, and 2B (or FIGS. 3, 3A, and 3B). For example, the bubble generating material 130 (or 230) can be coupled to a pumping chamber 125 (or 225). The pumping chamber 125 (or 225) can be coupled to a piston 120 (or 220). The piston 120 (or 220) can be movable between first and second positions and coupled to an actuator 110 (or 210).

The bubble generating material 130 (or 230) can be substantially wine-phobic and can allow substantially no wine into the device 100 (or 200). In various embodiments, providing a bubble generating material 130 (or 230) can include providing a bubble generating material 130 (or 230) that has a surface energy that is less than or equal to about 50 dynes/cm, less than or equal to about 45 dynes/cm, less than or equal to about 40 dynes/cm, less than or equal to about 35 dynes/cm, less than or equal to about 30 dynes/cm, less than or equal to about 25 dynes/cm, less than or equal to about 20 dynes/cm, less than or equal to about 15 dynes/cm, or less than or equal to about 10 dynes/cm. In some embodiments, providing a bubble generating material 130 (or 230) can include providing a bubble generating material 130 (or 230) that has a surface energy between about 10 dynes/cm to about 45 dynes/cm, between about 10 dynes/cm to about 40 dynes/cm, between about 10 dynes/cm to about 35 dynes/cm, between about 10 dynes/cm to about 30 dynes/cm, or between about 10 dynes/cm to about 25 dynes/cm. For example, the surface energy of the bubble generating material 130 (or 230) can be about 45 dynes/cm, about 40 dynes/cm, about 35 dynes/cm, about 30 dynes/cm, about 25 dynes/cm, about 20 dynes/cm, about 15 dynes/cm, or about 10 dynes/cm.

In addition, in certain embodiments, providing a bubble generating material 130 (or 230) can include providing a bubble generating material 130 (or 230) that has a surface energy that is less than the surface energy of wine by at least about 10 dynes/cm, by at least about 15 dynes/cm, by at least about 20 dynes/cm, by at least about 25 dynes/cm, by at least about 30 dynes/cm, by at least about 35 dynes/cm, by at least about 40 dynes/cm, or by at least about 45 dynes/cm. In some embodiments, providing a bubble generating material 130 (or 230) can include providing a bubble generating material 130 (or 230) that has a surface energy that is less than the surface energy of wine by about 10 dynes/cm to about 45 dynes/cm, by about 15 dynes/cm to about 45 dynes/cm, by about 20 dynes/cm to about 45 dynes/cm, or by about 25 dynes/cm to about 45 dynes/cm. An example bubble generating material 130 (or 230) can include a fluoropolymer.

In certain embodiments, the bubble generating material 130 (or 230) can have an average pore size (e.g., diameter) less than about 0.7 micron, less than about 0.6 micron, less than about 0.5 micron, or less than about 0.4 micron. For example, the average pore size (e.g., diameter) can be between about 0.4 micron to about 0.7 micron, or between about 0.4 micron to about 0.6 micron. For example, the average pore size (e.g., diameter) can be about 0.4 micron, about 0.45 micron, about 0.5 micron, about 0.55 micron, or about 0.6 micron.

As shown in operational block 420, the method 400 can include applying and releasing a force on the actuator 110 (or 210) such that the piston 120 (or 220) moves between first and second positions. As shown in operational block 430, the method 400 can also include injecting a metered amount of air from the pumping chamber 125 (or 225) out through the bubble generating material 130 (or 230) to generate air bubbles into the container of wine. In some embodiments, injecting the metered amount of air as shown in operational block 430 can occur simultaneously with applying the force on the actuator 110 (or 210). In other embodiments, injecting the metered amount of air as shown in operational block 430 can occur simultaneously with releasing the force on the actuator 110 (or 210).

Injecting the metered amount of air can include injecting between about 1 cubic inch to about 1.4 cubic inches (between about 16.4 $cm^3$ to about 22.9 $cm^3$) of air, or between about 1.1 cubic inches to about 1.3 cubic inches (between about 18 $cm^3$ to about 21.3 $cm^3$) of air. For example, the metered amount of air can be about 1.15 cubic inches (about 18.8 $cm^3$), about 1.2 cubic inches (about 19.7 $cm^3$), or about 1.25 cubic inches (about 20.5 $cm^3$) of air. Injecting the metered amount of air can also include generating air bubbles having an average bubble diameter that is less than about 0.07 inches (less than about 1.8 mm), less than about 0.06 inches (less than about 1.5 mm), less than about 0.05 inches (less than about 1.3 mm), less than about 0.04 inches (less than about 1 mm), or less than about 0.03 inches (less than about 0.8 mm). In some embodiments, the average bubble diameter is between about 0.03 inches to about 0.07 inches, between about 0.04 inches to about 0.06 inches, or between about 0.03 inches to about 0.06 inches. For example, the average bubble diameter can be about 0.03 inches, about 0.04 inches, about 0.05 inches, or about 0.06 inches.

Various modifications to the example embodiments described herein can be made. For example, the wine aerating device 100 (or 200) can comprise a housing 105 (or 205), a gas chamber 125 (or 225) within the housing 105 (or 205), and a controller 110 (or 210) operatively coupled to the gas chamber 125 (or 225). The device 100 (or 200) can also include a bubble generating material 130 (or 230) comprising a fluoropolymer (e.g., an expanded fluoropolymer fiber). The bubble generating material 130 (or 230) can be coupled to the gas chamber 125 (or 225). Actuating the controller 110 (or 210) can inject a metered amount of gas from the gas chamber 125 (or 225) out through the bubble generating material 130 (or 230) to generate bubbles into a container of wine. In some embodiments, actuating the controller 110 (or 210) injects the metered amount of gas using an electric motor to drive a pump. In some other embodiments, actuating the controller 110 (or 210) injects the metered amount of gas using a stored energy pump. Furthermore, in some embodiments, the gas chamber 125 (or 225) can include a compressed gas canister.

The terms "about" and "substantially" as used herein represent an amount equal to or close to the stated amount (e.g., an amount that still performs a desired function or achieves a desired result). For example, unless otherwise stated, the terms "about" and "substantially" may refer to an amount that is within (e.g., above or below) 10% of, within (e.g., above or below) 5% of, within (e.g., above or below) 1% of, within (e.g., above or below) 0.1% of, or within (e.g., above or below) 0.01% of the stated amount Although the foregoing description has shown, described, and pointed out various features of the present teachings, it will be understood that various omissions, substitutions, and changes in the form of the details described or illustrated, may be made by those skilled in the art, without departing from the scope of the present teachings. Consequently, the scope of the present teachings should not be limited to the foregoing discussion.

What is claimed is:

1. A wine aerating device comprising:

an actuator;

a piston movable between first and second positions;

a pumping chamber coupled to the piston; and a bubble generating material that is substantially non-wicking, the bubble generating material coupled to the pumping chamber, wherein upon application and release of a force on the actuator, the piston moves between the first and second positions to inject a metered amount of air from the pumping chamber out through the bubble generating material to generate air bubbles into a container of wine.

2. The wine aerating device of claim 1, wherein movement of the piston from the first position to the second position injects the metered amount of air towards the bubble generating material and further movement of the piston from the second position back to the first position allows air into the pumping chamber.

3. The wine aerating device of claim 1, wherein movement of the piston from the first position to the second position allows air into the pumping chamber, and further movement of the piston from the second position back to the first position injects the metered amount of air towards the bubble generating material.

4. The wine aerating device of claim 1, further comprising a spring coupled to the piston that moves the piston from the second position back to the first position.

5. The wine aerating device of claim 1, wherein the metered amount of air is between about 1 cubic inch to about 1.4 cubic inches.

6. The wine aerating device of claim 1, wherein the bubble generating material has an average pore diameter that is between about 0.4 micron to about 0.7 micron.

7. The wine aerating device of claim 1, wherein the generated air bubbles have an average bubble diameter that is between about 0.03 inches to about 0.07 inches.

8. The wine aerating device of claim 1, further comprising a transfer tube between the pumping chamber and the bubble generating material.

9. The wine aerating device of claim 1, wherein the bubble generating material is substantially wine-phobic and allows substantially no wine into the device.

10. The wine aerating device of claim 1, wherein the bubble generating material has a surface energy that is between about 10 dynes/cm to about 45 dynes/cm.

11. The wine aerating device of claim 1, wherein the bubble generating material has a surface energy that is less than the surface energy of wine by about 10 dynes/cm to about 45 dynes/cm.

12. The wine aerating device of claim 1, wherein the bubble generating material comprises a fluoropolymer.

13. A wine aerating device comprising:

a housing;

a gas chamber within the housing;

a controller operatively coupled to the gas chamber; and a bubble generating material that is substantially non-wicking, the bubble generating material comprising a fluoropolymer, the bubble generating material coupled to the gas chamber, wherein actuating the controller injects a metered amount of gas from the gas chamber out through the bubble generating material to generate bubbles into a container of wine.

14. The wine aerating device of claim 13, wherein actuating the controller injects the metered amount of gas using an electric motor to drive a pump.

15. The wine aerating device of claim 13, wherein actuating the controller injects the metered amount of gas using a stored energy pump.

16. The wine aerating device of claim 13, wherein the gas chamber includes a compressed gas canister.

17. The wine aerating device of claim 13, wherein the bubble generating material is substantially wine-phobic and allows substantially no wine into the device.

18. The wine aerating device of claim 13, wherein the bubble generating material has a surface energy that is between about 10 dynes/cm to about 45 dynes/cm.

19. The wine aerating device of claim 13, wherein the bubble generating material has a surface energy that is less than the surface energy of wine by about 10 dynes/cm to about 45 dynes/cm.

20. The wine aerating device of claim 13, wherein the bubble generating material has an average pore diameter that is between about 0.4 micron to about 0.7 micron.

21. The wine aerating device of claim 13, wherein the generated bubbles have an average bubble diameter that is between about 0.03 inches to about 0.07 inches.

22. The wine aerating device of claim 13, wherein the metered amount of gas is between about 1 cubic inch to about 1.4 cubic inches of gas.

* * * * *